US005725416A

United States Patent [19]

Russell

[11] Patent Number: 5,725,416

[45] Date of Patent: Mar. 10, 1998

[54] APPARATUS AND METHOD FOR MAKING AND USING A COMBINED CUTTING/GRINDING WHEEL

[76] Inventor: Jerry Russell, 95 Windsor Rd., Rochester Hills, Mich. 48307

[21] Appl. No.: 761,970

[22] Filed: Dec. 10, 1996

Related U.S. Application Data

[60] Provisional application No. 60/008,906, Dec. 20, 1995.

[51] Int. Cl.[6] ..... B24B 1/00

[52] U.S. Cl. ..... 451/54; 451/541; 451/547; 451/543; 241/293

[58] Field of Search ..... 451/547, 541, 451/54, 69, 70, 461, 543; 125/11.18, 11.04, 15; 408/27; 407/61, 42, 57; 241/DIG. 31, 292.1, 293, 235

[56] References Cited

U.S. PATENT DOCUMENTS

| | | | |
|---|---|---|---|
| 3,865,164 | 2/1975 | Sybertz | 214/292.1 |
| 3,916,579 | 11/1975 | Waller et al. | 451/547 |
| 4,978,254 | 12/1990 | Langlois et al. | 451/547 |
| 5,000,625 | 3/1991 | Arai et al. | 407/42 |
| 5,052,154 | 10/1991 | Lehman | 451/547 |
| 5,092,083 | 3/1992 | Raffaelli | 451/543 |
| 5,399,116 | 3/1995 | Ellis et al. | 451/547 |
| 5,549,510 | 8/1996 | Fukuda et al. | 451/547 |
| 5,595,533 | 1/1997 | Kumazaki | 451/541 |

FOREIGN PATENT DOCUMENTS

| | | | |
|---|---|---|---|
| 542054 | 12/1941 | United Kingdom | 451/541 |

*Primary Examiner*—Robert A. Rose
*Assistant Examiner*—George Nguyen
*Attorney, Agent, or Firm*—Reising, Ethington, Barnard & Perry

[57] ABSTRACT

A combined cutting/grinding tool comprises a grinding wheel with an exterior circumferential grinding surface for profiling an object surface of a product to be manufactured. The grinding surface includes an abrasive grit. A profile is formed in the grinding surface for grinding a corresponding profile into the object surface. A plurality of inserts are inserted into a plurality of slots formed in the grinding surface. A cutting portion of each insert extends radially and integrally outward from the grinding surface to cut detail into the object surface of the part to be manufactured.

19 Claims, 2 Drawing Sheets

APPARATUS AND METHOD FOR MAKING AND USING A COMBINED CUTTING/ GRINDING WHEEL

This application is based on Provisional Application No. 60/008,906 filed on Dec. 20, 1995.

TECHNICAL FIELD

The present invention relates to a combined cutting/ grinding tool which can impart a profile of any desirable configuration to a part to be manufactured.

BACKGROUND OF THE INVENTION

Products that can be molded, machined or ground have long had profiles (contours) produced by molding, machining or grinding. Without limitation, but by way of background only, one such type of part is a belt, made of rubber, such as a v-belt. In some instances, such as in the manufacture of belts, a desired profile may be molded into the belt as the belt itself is molded.

The profile of the part to be made can be of virtually any configuration that can be machined or ground. In many instances, when grinding is used to profile a part, the action of the grinding tool imparts surface characteristics to the profiled portion of the part that are superior to the surface characteristics achieved through machine cutting. Profile grinding allows greater control of surface finish on materials that are difficult to machine. However, there are limits to the form that a grinding tool can take and, therefore, in the shapes that it can profile into a product to be manufactured. Molding and machine cutting can, in some instances, be more effective in profiling certain shapes than grinding. Moreover, the way in which grinding tools form surfaces can limit the life of a grinding tool.

Machining cutters have certain advantages over grinding tools. Typically, machining cutters have longer lives and, therefore, offer greater production capabilities than grinding tools. Also, machining cutters can profile more intricate detail into the part being produced than grinding tools.

In many instances, the drawbacks of machine cutting more than offset such advantages. For example, the superior surface characteristics imparted by grinding are sacrificed when a cutting tool is used.

Tools are available that are able to mold, machine cut or grind virtually any material into a given profile. However, what is needed is a single tool that is able to impart the superior surface characteristics of a grinding tool while, at the same time, profiling the intricate cuts of a cutting tool.

SUMMARY OF THE INVENTION

In accordance with this invention a combination grinding/ cutting tool is provided that includes a grinding wheel with the cutting portions of a plurality of inserts with cutting portions that extend outward from an abrasive-lined profiled grinding surface. The grinding surface imparts the superior surface characteristics of a grinding tool while the insert cutting portions profile the intricate cuts of a cutting tool.

Unlike prior art cutting and grinding tools, the present invention includes both cutting and grinding implements on a single grinding wheel. The combination reduces costs and increases production rates by allowing cutting and grinding operations to be carried on simultaneously and by a single machine. In addition, the cutting and grinding implements of the present invention are arranged to take advantage of the superior characteristics of each.

In accordance with another aspect of the present invention, one or more slots may be formed in the grinding surface to receive one or more inserts. This allows the inserts to be fabricated separately from the grinding wheel.

In accordance with still another aspect of the present invention, one or more of the slots may be adapted to receive both an insert and a wedge block shaped to exert retaining pressure against the insert as the wedge block is fastened into the slot. The use of such a wedge block to install inserts allows the inserts to be more easily removed for replacement or re-honing.

In accordance with the present invention a method is provided for making a combined cutting/grinding tool. The method includes the steps of forming the grinding wheel, forming a slot in the grinding wheel grinding surface, profiling an outer surface of the grinding wheel to correspond to a desired profile to be formed in an object surface of a manufactured object, applying and securing an abrasive to the grinding wheel outer surface, forming an insert with a body portion shaped to fit within the slot, and inserting and securing the body portion of the insert into the slot.

In accordance with the present invention a method is provided for profiling a part using a combined cutting/ grinding tool. The method includes the steps of forming the grinding wheel with the insert cutting portions extending outward from the grinding surface, spinning the grinding wheel, moving the object surface of a product to be manufactured into contact with the grinding surface and inserts until the grinding surface and cutting portion have formed a desired profile in the object surface, and removing the product from the grinding wheel.

BRIEF DESCRIPTION OF THE DRAWINGS

To better understand and appreciate the invention, refer to the following detailed description in connection with the accompanying drawings.

DETAILED DESCRIPTION OF THE DRAWINGS

A combined cutting/grinding tool made in accordance with the present invention is generally shown at 10 in the figures. Generally, the tool comprises a grinding wheel 12 having at least one opening or slot 14 for receiving a cutting insert generally indicated at 16.

The grinding wheel 12 has a contoured exterior circumferential grinding surface 18 matching the profile of a part to be manufactured by the tool 10. That is, the exterior grinding surface 18 of the grinding wheel 12 includes a predetermined profile for making the profile in an object surface of the product to be manufactured. As shown in the figures, the profile on the exterior grinding surface 18 of the grinding wheel 12 is arcuate. It will be appreciated that the grinding surface 18 of the grinding wheel 12 can have any desired configuration to make any profile in the object surface of the part to be manufactured.

Figure 4:
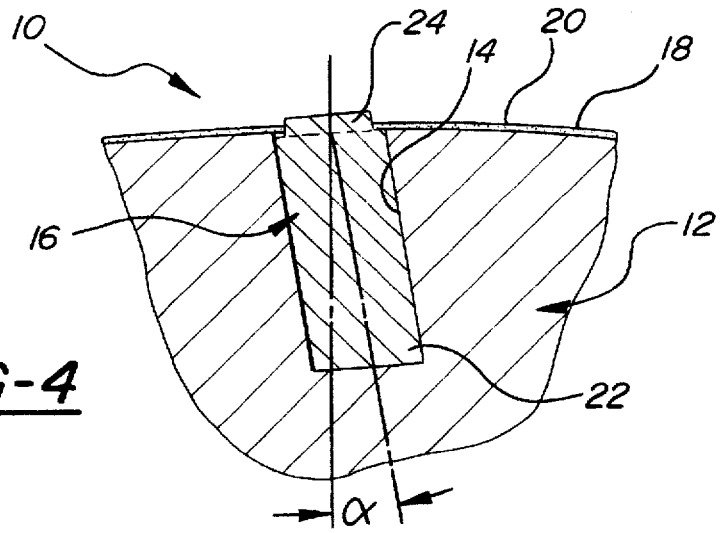
FIG. 4 is an enlarged fragmentary cross-sectional side view of the portion of the tool shown in FIG. 1.
Figure 5:
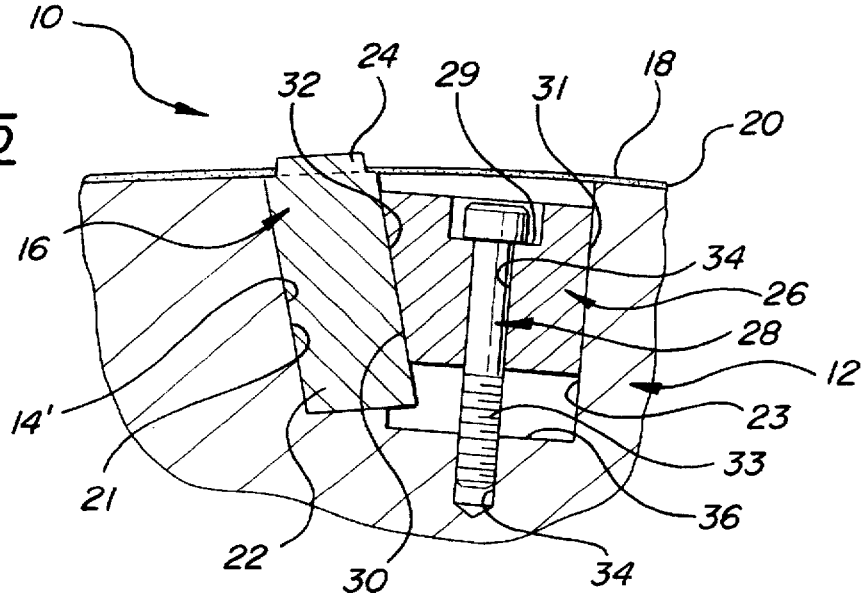
FIG. 5 is an enlarged fragmentary partial-cross-sectional side view of a second embodiment of a tool made in accordance with the present invention.

The exterior circumferential grinding surface 18 of the grinding wheel 12 includes an abrasive grit 20. The abrasive grit 20 is best shown in FIGS. 4 and 5. The abrasive grit 20 can comprise any grit well known in the art, such as tungsten carbide, diamonds or the like. Thus, the grinding wheel 12 comprises a substrate to which the abrasive grit 20 is secured. The abrasive grit can be applied to the substrate or blank in any matter well known in the art. In the preferred embodiment the profile of the abrading (grinding) surface closely matches the profile of the object surface of the part to be manufactured.

In other embodiments, the profiled grinding surface 18 may be disposed on an exterior surface of the grinding wheel other than a circumferential surface. For example, the grinding surface 18 may be disposed on the grinding wheel face, shown at 38 in FIG. 1, with the inserts 16 protruding at various points on the grinding wheel face 38.

Figure 2:
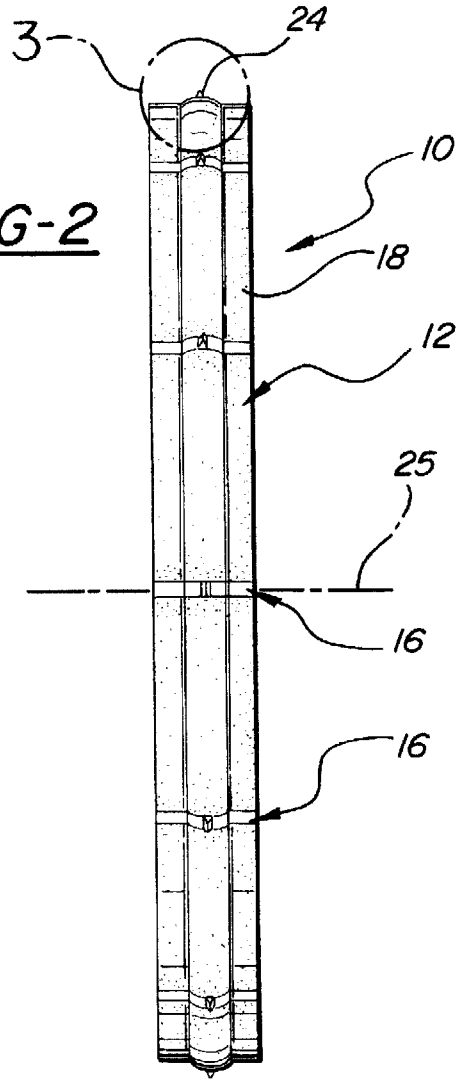
FIG. 2 is an end view of a tool shown in FIG. 1.
Figure 1:
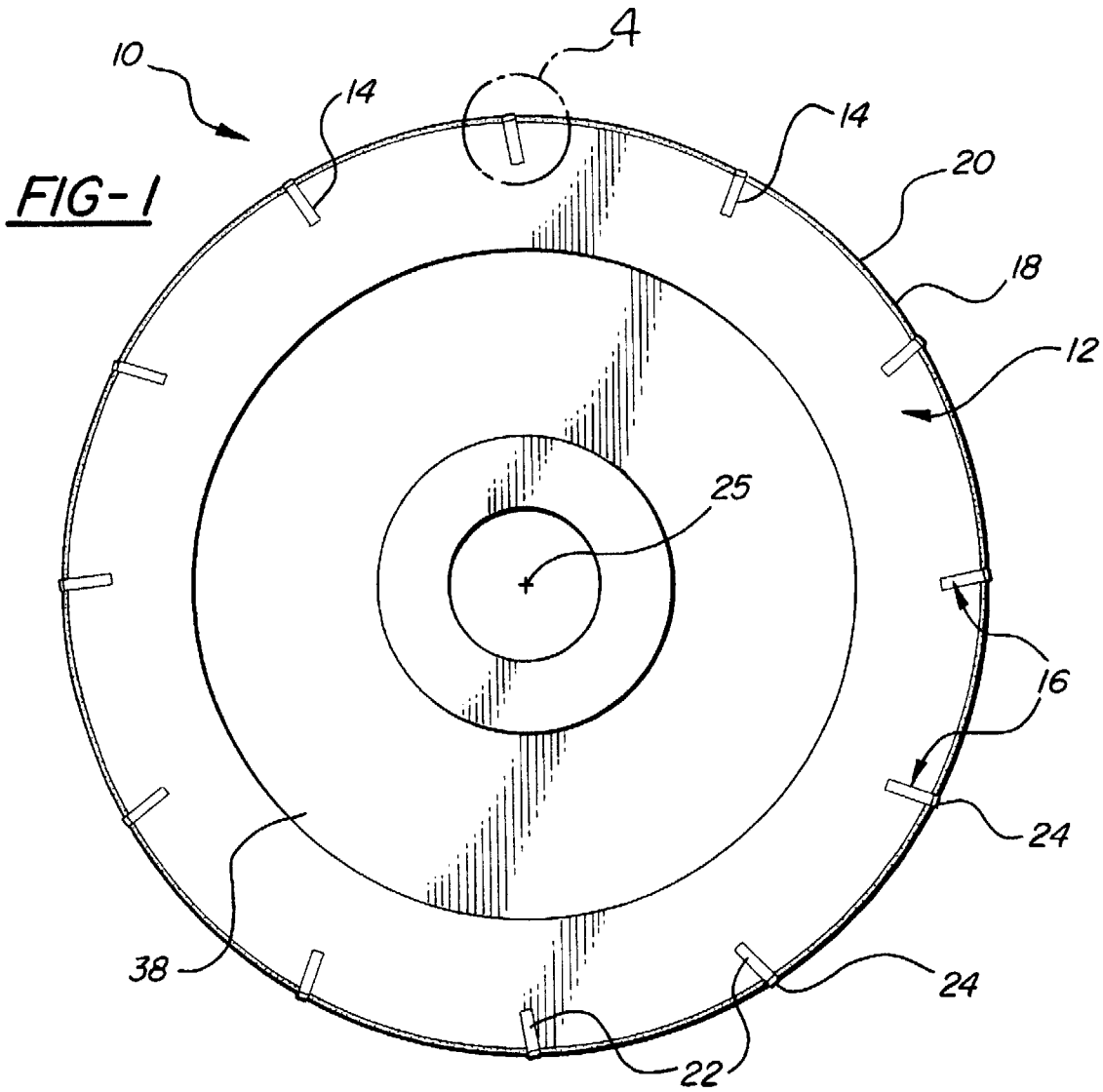
FIG. 1 is a side view of a tool made in accordance with the present invention.

As best shown in FIG. 1, the tool 10 includes at least one and preferably a plurality of slots 14 extending inwardly from the grinding surface 18 and spaced circumferentially around the grinding wheel 12. The slots 14 are adapted for receiving a cutting insert 16. While the preferred embodiment includes a plurality of slots 14, other embodiments may include only a single slot 14.

The slots 14 extend from the exterior surface 18 of the grinding wheel 12 inwardly toward the center of the grinding wheel 12. The slot 14 generally extend in the radial direction. As best shown in FIG. 4, the slots 14 may be angled relative to the true radial direction. That is, the slots 14 may be disposed on an angle $\alpha$ relative to perpendicular to the exterior surface 18. The slots 14 may be placed at any angle $\alpha$, depending on the part to be manufactured.

The slots 14 may include one or more side walls to comprise a pocket for receiving the insert 16. In one alternative embodiment, each slot is enlarged to form a wedge block receptacle, as shown at 14' in FIG. 5. Each wedge block receptacle 14' includes first 21 and second 23 opposing receptacle sidewalls spaced far enough apart to also accommodate a wedge block 26 for mechanically retaining the insert 16. An insert 16 is disposed flush against the first receptacle sidewall 21 and is spaced from the second receptacle sidewall 23. The first receptacle sidewall 21 is slanted outward, as shown in FIG. 5, so that the greatest distance between the two walls is measured at the point where the sidewalls 21, 23 meet the exterior circumferential grinding surface 18 of the grinding wheel 12.

A wedge block, or shim 26 is shaped to fit between the insert 16 and the second receptacle sidewall 23. The wedge block 26 has the shape of a trapezoidical prism having a first non-parallel side 30 angled to lie in a generally parallel disposition against an outer surface 32 of the insert 16 and a second non-parallel side 31 angled to lie in a generally parallel disposition against the second sidewall 23.

The shape of the wedge block 26 allows it to be inserted into the wedge block receptacle 14' to retain or jam the insert 26 against the first receptacle sidewall 21, retaining the insert 16 in the installed position in the slot 14'.

A fastener in the form of a bolt 28 passes through a cylindrical aperture 34 formed vertically through the wedge block 26 with the head of the bolt 28 engaging an upper surface 29 of the wedge block 26. A threaded shaft portion 33 of the bolt 28 threads into a threaded hole 34 extending radially inward from a floor 36 of the receptacle 14' toward a central rotational axis 25 of the grinding wheel 12. The bolt 28 is therefore adjustably connected to the grinding wheel 12 to allow an installer to draw the wedge block 26 into the receptacle 14' or to back the wedge block 26 out of the receptacle 14' by threading the bolt 28 into or out of the threaded hole 34.

Figure 3:
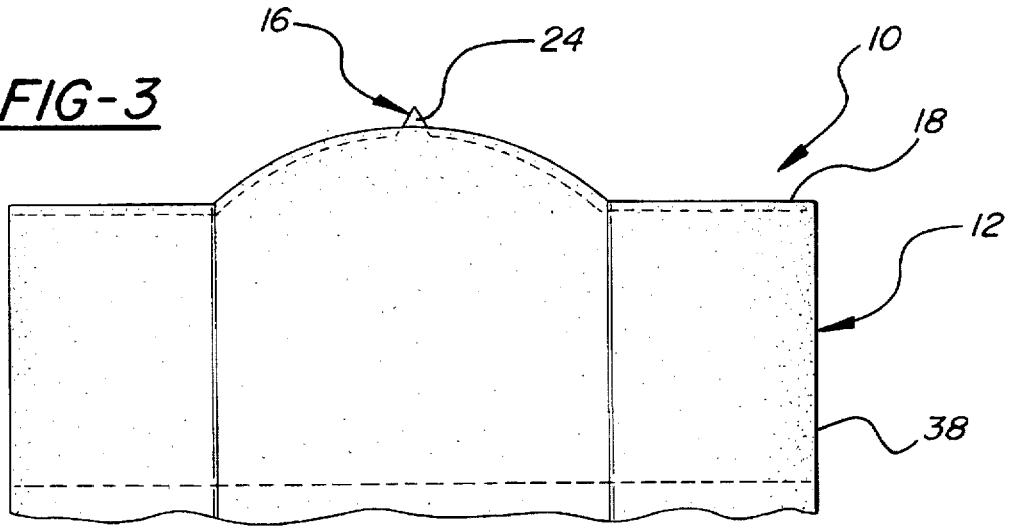
FIG. 3 is an enlarged fragmentary view of the portion of the tool shown in FIG. 2.

As is best shown in FIGS. 3–5, each cutting insert 16 includes a cutting portion 24 that extends integrally and radially outward from the grinding surface 18. In the present embodiment, the inserts 16 are fabricated separately from the grinding wheel 12. However, in other embodiments, the "inserts" may be integrally formed with the grinding wheel 12 as a single unitary piece by casting or machining or like processes known in the art.

As shown in FIGS. 4 and 5, in the present embodiment, each cutting insert 16 also includes a body portion 22 that is insertable and retainable within any one of the slots 14. The body portion 22 integrally extends from the cutting portion 24. Preferably, the body portion 22 and the cutting portion 24 are integrally formed as a unitary member. It will be appreciated, however, that the body portion 22 and the cutting portion 24 of each slot 14 may be separately formed and secured together in any suitable manner.

The cutting surface of each insert 16 is disposed such that it extends radially outwardly from the outer circumferential grinding surface 18 of the wheel 12. In this manner, the cutting surface of each insert 16 cuts the part to be manufactured. As is best shown in FIG. 3, a cutting portion 24 of each insert 16 includes a peaked cutting surface. This peaked cutting surface has no abrasive grit and does not grind the part to be profiled. Rather, the cutting portion 24 comprises a cutting tool. In the preferred embodiment, each of the inserts 16 have cutting portions 24 that are identical in configuration. The insert cutting portions 24 extend outward from around the grinding wheel 12 grinding surface 18 in a co-planar spaced-apart disposition. In other words, the inserts 16 of the preferred embodiment are all circumferentially aligned in a single ring around the circumferential grinding surface 18 of the grinding wheel 12 to cut the identical profile in the part to be manufactured.

In other embodiments, the cutting portion 24 of each insert 16 may have any configuration and may be fixed to any portion of the grinding surface 18, depending on the part to be manufactured. In other words, the configuration and/or placement of one or more insert cutting portions 24 may differ from the others on a grinding wheel 12. By using inserts 16 having cutting portions 24 with different configurations and placements, different cutting configurations may be effected in the object surface of a product to be manufactured.

The body portion 22 of the cutting insert 16 is disposed in the slot 14. The cutting insert 16 can be held in the slot 14 in any mechanical or bonded fashion, such as by induction brazing or welding or by the use of a strong adhesive. In other embodiments, the insert 16 may comprise only a cutting portion 24 projecting outwardly from the exterior circumferential surface 18 of the grinding wheel 12. In such embodiments, the cutting portion 24 may be bonded to the exterior circumferential surface 18 in any mechanical or bonded fashion, such as by induction brazing or welding; or may be formed with the grinding wheel 12 by machining or casting.

To make a combined cutting/grinding tool 10 according to the present invention, a blank wheel 12 is machined to the desired configuration. In other embodiments, the wheel 12 may formed into the desired configuration by other well-known methods such as casting. A plurality of slots 14 are placed circumferentially around the wheel 12. Each of the slots 14 extend inwardly from the exterior surface 18 of the wheel 12. After the slots 14 have been placed in the wheel 12, the exterior surface 18 of the wheel 12 is profiled to the desired configuration. Next, an abrasive grit 20 is applied and secured about the exterior profile configuration of the wheel 12. The wheel 12 having the grit 20 thereon is then dressed to its final configuration. Next, the cutting inserts 16 are formed. Preferably, the outside shape of the body portion 22 closely matches the profile of exterior surface 18 of the grinding wheel 12 but does not extend to or beyond the exterior surface 18, as shown in FIG. 3. In other words, the body portion 22 should be shaped to lie flush with, rather than to protrude from, the grinding surface 18. Each of the cutting tools, i.e., the inserts 16, are then inserted into the slots 14 and secured either mechanically or bonded such as by brazing or welding.

As representatively shown in FIG. 5, other embodiments may include larger slots 14' formed to receive wedge blocks 26 for mechanically retaining the inserts 16. The wedge blocks 26 are fabricated to fit within these wedge block receptacles 14' along with threaded fasteners 28 to engage and draw the wedge blocks 26 into the receptacles 14' to clamp the inserts 16 into their installed positions.

To profile a part using a combined cutting/grinding tool 10 constructed according to the present invention the grinding wheel 12 is first formed with insert cutting portions 24 extending outward from the grinding surface 18 as described above. The grinding wheel 12 is then rotatably mounted and spun about the central rotational axis 25 by a driving mechanism such as an electric motor or by other means known in the art. The wheel 12 is spun to cause the circumferential grinding surface 18 to spin and the cutting portions 24 to orbit about the central rotational axis 25. The object surface of a product to be manufactured is then moved into a position contacting the spinning grinding surface 18 of the wheel 12 and the orbiting insert cutting portions 24. The object surface of the product continues to be moved toward the spinning grinding surface 18 and the orbiting insert cutting portions 24 until the grinding surface 18 and cutting portions 24 have formed a desired profile in the object surface. The product is then removed from contact with the grinding wheel 12.

In this manner, the object surface of a part to be manufactured is simultaneously ground and cut by the combination grinding and cutting tool 10. The grinding is done by the abrasive grit 20 about the exterior surface 18 of the grinding wheel 12. The detail is cut into the object surface of the part to be manufactured by the cutting portion 24 of the insert 16 which extends outwardly of the exterior grinding surface 18, i.e., the abrading surface, of the grinding wheel 12. The bulk of the work done by the tool 10 in forming the part to be manufactured is done by the abrasive grit 20 about the exterior surface 18 of the grinding wheel 12. This provides the part to be manufactured with the superior characteristics of a ground profile. Furthermore, the detail is cut into the part to be manufactured by the cutting portion 24 of the insert 16. This provides the benefit of the intricate cuts which were not heretofore available by grinding alone. Thus, the combination tool 10 combines the benefits of producing a ground part with that of producing a machine cut part.

It will be appreciated that because the configuration of the profile of the abrading and cutting tool 10 can take any shape, any part, or number of parts can be made simultaneously by one combined grinding and cutting tool 10. While the present invention could be used to form a wide variety of profiles in the surfaces of items made of virtually any material, it is particularly useful for forming items such as rubber, plastic or urethane belts. The present invention may be used to form either circumferential or lateral profiles in the interior or exterior circumferential surfaces of such belts merely by altering the mounting arrangement and orientation of the grinding wheel 12 in relation to a given belt.

This is an illustrative description of the invention using words of description rather than of limitation. Obviously, many modifications and variations of this invention are possible in light of the above teachings. Within the scope of the claims one may practice the invention other than as described.

I claim:

1. A combined cutting/grinding tool, said tool comprising:

a grinding wheel having a central rotational axis and including an exterior grinding surface for profiling an object surface of a product to be manufactured, said grinding surface comprising an abrasive;

a grinding profile formed in said grinding surface to grind a corresponding first profile into the object surface; and an insert including a cutting portion, the cutting portion protruding generally radially outward from said grinding surface and having a cutting profile different from the grinding profile to cut a corresponding second profile into the object surface different from the first profile.

2. A combined cutting/grinding tool as defined in claim 1 wherein said grinding wheel includes an exterior circumferential surface comprising said exterior grinding surface, said profile is formed in said grinding surface and said cutting portion extends radially outward from said grinding surface relative to the wheel axis.

3. A combined cutting/grinding tool as defined in claim 1, wherein said grinding wheel includes a slot extending inwardly from said grinding surface.

4. A combined cutting/grinding tool as defined in claim 3 wherein said insert includes a body portion insertable and retainable within said slot, said body portion integrally extending from said cutting portion.

5. A combined cutting/grinding tool as defined in claim 4 wherein said insert body portion and cutting portion are integrally formed as a single unitary member.

6. A combined cutting/grinding tool as defined in claim 1 wherein said insert cutting portion includes at least one peaked cutting surface.

7. A combined cutting/grinding tool as defined in claim 1 further including a plurality of inserts, each insert of said plurality of inserts fixed to said grinding wheel and including a cutting portion extending integrally outward from said grinding surface.

8. A combined cutting/grinding tool as defined in claim 7 wherein said insert cutting portions extend outward from around said grinding wheel grinding surface in a spaced-apart disposition.

9. A combined cutting/grinding tool as defined in claim 7 wherein said cutting portions are disposed in circumferential alignment with one another.

10. A combined cutting/grinding tool as defined in claim 7 wherein at least one of said plurality of inserts includes a cutting portion shaped differently from the cutting portion of at least one of the other of said inserts.

11. A combined cutting/grinding tool as defined in claim 7 wherein said grinding wheel includes a plurality of slots disposed in said grinding surface and where each insert of said plurality of inserts includes a body portion disposed within one of said plurality of slots in an installed position.

12. A combined cutting/grinding tool as defined in claim 11 wherein at least one of said slots includes first and second opposing slot sidewalls and where at least one of said inserts is disposed flush against said first slot sidewall and is spaced from said second slot sidewall, said cutting/grinding tool further including a wedge block shaped to fit between said insert and said second slot sidewall, said wedge block insertable into said slot to retain said insert in said installed position in said slot.

13. A combined cutting/grinding tool as defined in claim 12 further including a fastener connected to said wedge block and said grinding wheel and adjustably connected to one of said wedge block and said grinding wheel.

14. A method for making a combined cutting/grinding tool comprising a grinding wheel including a central rotational axis and an exterior circumferential surface comprising a grinding surface for profiling an object surface of a product to be manufactured, and an insert including a cutting portion protruding integrally outward from the grinding surface, said method including the steps of:

providing the grinding wheel;

providing a slot in the grinding wheel grinding surface;

profiling the grinding surface to correspond to a desired profile to be formed in an object surface of a manufactured object;

providing an abrasive on the grinding surface;

providing an insert with a body portion shaped to fit within the slot; and inserting and securing the body portion of the insert into the slot with the cutting portion extending radially outward from the grinding surface relative to the central rotational axis of the grinding wheel.

15. A method for making a combined cutting and grinding tool as set forth in claim 14 wherein said step of forming the grinding wheel includes the step of forming the profiled grinding surface on an exterior circumferential surface of the grinding wheel.

16. A method for making a combined cutting/grinding tool as set forth in claim 15 further including the step of fabricating a wedge block.

17. A method for making a combined cutting/grinding tool as set forth in claim 16 wherein the step of forming a slot includes the step of forming a wedge block receptacle.

18. A method for profiling a part using a combined cutting/grinding tool comprising a grinding wheel including a central rotational axis and an exterior circumferential surface comprising a grinding surface for profiling an object surface of a product to be manufactured, the grinding surface comprising an abrasive, a profile formed in the grinding surface to grind a corresponding profile into the object surface, and an insert including a cutting portion protruding integrally outward from the grinding surface, said method including the steps of:

providing the grinding wheel with the insert cutting portion extending radially outward from the grinding surface relative to the central rotational axis;

spinning the grinding wheel about the central rotational axis to cause the grinding surface to spin and the cutting portions to orbit about the central rotational axis;

moving the object surface of a product to be manufactured into a position contacting the spinning grinding surface of the wheel and the orbiting insert cutting portion;

continuing to move the object surface of the product toward the spinning grinding surface and the orbiting insert cutting portion until the grinding surface and cutting portion have formed a desired profile in the object surface; and removing the product from the grinding wheel.

19. A combined cutting/grinding tool, said tool comprising:

a grinding wheel including an exterior grinding surface for profiling an object surface of a product to be manufactured, said grinding surface comprising an abrasive;

a profile formed in said grinding surface to grind a corresponding profile into the object surface;

an insert including a cutting portion extending generally radially outward from said grinding surface; and a plurality of inserts, each insert of said plurality of inserts fixed to said grinding wheel and including a cutting portion extending integrally outward from said grinding surface, at least one of said plurality of inserts including a cutting portion shaped differently from the cutting portion of at least one of the other of said inserts.

* * * * *